US005747234A

United States Patent [19]

Wexler et al.

[11] Patent Number: 5,747,234

[45] Date of Patent: May 5, 1998

[54] PHOTOGRAPHIC ELEMENT

[75] Inventors: Ronald Myron Wexler; Robert Owen James; Vito A. DePalma; John Francis Decory, all of Rochester; Lloyd A. Lobo, Webster, all of N.Y.

[73] Assignee: Eastman Kodak Company, Rochester, N.Y.

[21] Appl. No.: 667,263

[22] Filed: Jun. 20, 1996

Related U.S. Application Data

[60] Provisional application No. 60/009,419, Nov. 13, 1995.

[51] Int. Cl. [6] ..... G03C 11/06; G03C 1/76

[52] U.S. Cl. ..... 430/523; 430/961

[58] Field of Search ..... 430/523, 961

[56] References Cited

U.S. PATENT DOCUMENTS

| | | | |
|---|---|---|---|
| 3,782,947 | 1/1974 | Krall | 96/67 |
| 4,279,945 | 7/1981 | Audran et al. | 427/130 |
| 4,820,615 | 4/1989 | Vandenabeele et al. | 430/523 |
| 4,891,307 | 1/1990 | Mukunoki et al. | 430/523 |
| 4,990,276 | 2/1991 | Bishop et al. | 225/62.54 |
| 5,137,802 | 8/1992 | Ueda et al. | 430/523 |
| 5,147,768 | 9/1992 | Sakakibara | 430/501 |
| 5,217,804 | 6/1993 | James et al. | 428/329 |
| 5,229,259 | 7/1993 | Yokota | 430/523 |
| 5,382,494 | 1/1995 | Kudo et al. | 430/140 |
| 5,395,743 | 3/1995 | Brick et al. | 430/496 |
| 5,397,826 | 3/1995 | Wexler | 524/356 |
| 5,423,050 | 6/1995 | Taylor et al. | 395/575 |
| 5,427,900 | 6/1995 | James et al. | 430/496 |
| 5,434,037 | 7/1995 | Wexler et al. | 430/496 |
| 5,436,120 | 7/1995 | Wexler et al. | 430/496 |
| 5,514,528 | 5/1996 | Chen et al. | 430/530 |

*Primary Examiner*—Mark F. Huff
*Attorney, Agent, or Firm*—Carl F. Ruoff

[57] ABSTRACT

A photographic element comprising a support, a light-sensitive layer on one side of the support, and on the other side of the support, at least one backing layer and a protective outermost lubricating layer, the protective layer comprising a solid wax and a non-ionic fluorinated surfactant in an amount less than the surfactant's solubility in the wax, said protective layer being coated from a mixture of an aromatic solvent and at least one lower alkyl alcohol.

13 Claims, No Drawings

PHOTOGRAPHIC ELEMENT

CROSS REFERENCE TO RELATED APPLICATION

Reference is made to and priority claimed from U.S. provisional application Ser. No. 60/009,419, filed 13 Nov. 1995, entitled PHOTOGRAPHIC ELEMENT.

FIELD OF THE INVENTION

This invention relates to photographic elements and more particularly to photographic elements having a light-sensitive silver halide layer and a backing which is resistant to visible defects after processing, particularly in processes where squeegees are used to aid in the removal of processing fluids from the element.

BACKGROUND OF THE INVENTION

Silver halide color photographic light-sensitive materials are processed in color photographic processing laboratories and smaller scale laboratories know as "minilabs". It is common practice to develop color negative film for picture taking to obtain a negative image which is subsequently used for printing a positive image onto color print paper. During the processing of color negative films in automated processing laboratories, squeegees of various types are often employed to aid in the removal of processing fluids from the film. If such squeegees do not apply uniform pressure across the color negative photographic film during processing, processing fluids and/or the backing lubricant layer may form streaks and/or haze on part of the length and/or width of the the film. Such streaks and haze may be observed in the positive image print made with the color negative film and the prints are therefore of unacceptable quality.

It is known from various U.S. Pat. Nos., including 5,395,743; 5,397,826; 5,427,900; 5,432,050; 5,434,037; 5,436,120; and others; to include a coating aid surfactant in the formulation of backing layers to provide optically clear coatings that are free of defects. It is also known from various U.S. Pat. Nos., including: 3,782,947; 4,279,945; 4,990,276; 5,217,804; 5,147,768; 5,229,259; and others; to provide photographic elements containing a transparent magnetic recording layer. Such elements are advantageous because they can be employed to record images by the customary photographic process while at the same time information can be recorded into and read from the magnetic recording layer by the techniques similar to that employed in the magnetic recording art. Such backing layers require lubrication at the outer surface to allow numerous transports of the film through various equipment. It is known from U.S. Pat. No. 5,382,494 to coat a lubricant such as carnauba wax from toluene. However, such a solution has minimal conductivity and is subject to static discharge ignition on high speed coating machines.

PROBLEM TO BE SOLVED BY THE INVENTION

Thus, the presence of any residues, such as streaks or haze, from the processing of photographic elements must not interfere with the ability to read information from and write information to the magnetic recording layer on a silver halide photographic element. The magnetic recording layer must be capable of accurately recording the information applied thereto and reading out the information on demand even after processing of the film to allow accurate reprints, enlargements, and the like to be obtained.

The photographic element and particularly the transparent magnetic recording layer provided thereon must be capable of repeated use in both the recording and reading mode and, therefore, must have sufficient lubricity to allow transport of the element both before and after processing. For example, during the residence of the film in a camera, entries may be made to the magnetic recording layer for every exposure, and an indeterminate number of read operations are conducted depending on the particular application to which the film is used. This also is true in the processing of the film and in subsequent use of the processed film for additional copies, enlargements and the like. Hence, the lubricating layer must maintain its properties for transport of the element while at the same time not be susceptible to retaining residues from processing solutions or itself forming defects that could interfere with the optical or magnetic capabilities of the element. It would also be advantageous to coat such a lubricant from a more conductive solution than that described in U.S. Pat. No. 5,382,494 to be viable as a manufacturable product.

It can, therefore, be readily seen that it would be highly desirable to provide photographic elements with adequate lubricity for transport in a camera or processing equipment, the elements being resistant to the formation of visual defects. Further, it is desirable to provide imaging elements having transparent magnetic recording layers with adequate lubricity for transport past magnetic heads while resisting the deformation of the lubricant or formation of residues from processing solutions. Thus, all of these various characteristics must be considered both independently and cumulatively in order to arrive at a commercially viable photographic element containing a transparent magnetic recording layer that will withstand repeated and numerous passages through the recording and reading zones of a suitable apparatus.

SUMMARY OF THE INVENTION

The invention provides an improved photographic element including a support, a light-sensitive layer on one side of the support, and on the other side of the support, at least one backing layer and a protective outermost lubricating layer, the protective layer comprising a solid wax and a non-ionic fluorinated surfactant in an amount less than the compatibility limit of the surfactant in the wax, said protective layer being coated from a mixture of an aromatic solvent, such as benzene, toluene, ortho-, meta-, or para-xylene and mixtures thereof, and at least one lower alkyl alcohol.

When the backing is comprised of more than one layer, an inner layer may be a magnetic recording layer, the magnetic recording layer comprising a transparent polymeric binder and ferro-magnetic particles, the magnetic particles having a surface area greater than 30 $m^2$/gm and a coverage of from about $1\times10^{-11}$ mg/$\mu m^3$ to about $1\times10^{-10}$ mg/$\mu m^3$. Optionally, the magnetic recording layer may contain reinforcing filler particles and/or abrasive particles. Also, optionally, the magnetic recording layer may be crosslinked.

ADVANTAGEOUS EFFECT OF THE INVENTION

It has been found that above a critical level of a given surfactant, the surfactant may no longer be compatible with the lubricant. This may lead to phase separation of the surfactant from the lubricant. When phase separation occurs, the surfactant may be easily removed from the lubricant layer during processing resulting in a discontinuous, voidfilled lubricant layer. Upon passage through processing equipment, this layer may redistribute and/or retain processing chemicals which result in visible defects such as streaks or haze. While it is believed that this is the most important mechanism for formation of defects, other mechanisms may also play a role in generating defects, such as the crystallization of the wax or poor adhesion of the wax to the backing layer. Because of the simultaneous requirements of transportability, absence of visible defects including optical clarity, and resistance to lubricant layer redistribution and processing solution residues, the selection of the surfactant and the amount of surfactant are very critical since the surfactant may concentrate at the outside surface of the lubricant layer.

DETAILED DESCRIPTION OF THE INVENTION

The photographic elements according to this invention can be provided with a protective or lubricating wax layer over the backing layer, which may be a transparent magnetic recording layer. Preferably, the wax has a melting point of greater than about 55° C. Suitable wax lubricants include fatty acid-modified silicones, polyolefins, polyglycol alkyl phosphates and alkali metal salts thereof, alkyl sulfates and alkali metal salts thereof, monobasic fatty acids having 10 to 24 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 22 carbon atoms (which may contain unsaturated bonds or may be branched), alkoxy alcohols having 12 to 22 carbon atoms, mono-, di- and tri-esters of monobasic fatty acids having 10 to 24 carbon atoms (which may contain unsaturated bonds or may be branched) and monovalent, divalent, trivalent, tetravalent, pentavalent and hexavalent alcohols having 2 to 12 carbon atoms (which may contain unsaturated bonds or may be branched), fatty acid esters of monoalkyl ethers of alkylene oxide polymers, fatty acid amides having 8 to 22 carbon atoms and aliphatic amines having 8 to 22 carbon atoms.

Specific examples of these compounds (i.e., alcohols, acids or esters) include myristic acid, palmitic acid, stearic acid, behenic acid, and their lithium, sodium, potassium and zinc salts, butoxyethyl stearate, anhydrosorbitan monostearate, anhydrosorbitan distearate, anhydrosorbitan tristearate, pentaerythrityl tetrastearate, stearamide, hydrogenated jojoba oil and mineral waxes such as paraffin, microcrystalline mineral wax, oxidized microcrystalline mineral wax, montan wax, Hoechst wax, ozocerite wax, vegetable waxes such as carnauba wax, esparto wax, flax wax, sugar cane wax, candelilla wax, animal waxes such as beeswax, synthetic waxes such as Fischer-Tropsch wax. The solid wax is present in the protective lubricant layer in an amount of 0.5 to 3 micrograms/cm$^2$, preferably 1 to 2.5 micrograms/cm$^2$, and most preferably 1.5 to 2 micrograms/cm$^2$. Carnauba wax is preferred.

Suitable coating aids for coating the lubricant layer include nonionic fluorinated surfactants such as fluoroaliphatic polymeric esters, fluorosurfactants of the polyoxyethylene or polyalkyl ether type, or fluoroalkyl polyethers as set forth in U.S. Pat. Nos. 3,403,122, 3,787,351, 4,803,145, 4,835,084, 4,845,008 and 5,380,644 which are incorporated herein by reference. Suitable commercially available examples include FC-170C, FC-171, FC-430, FC-431, and FC-740 sold by Minnesota Mining and Manufacturing Co., ZONYL FSN and ZONYL FSO sold by DuPont, FORAFAC 1110D and FORAFAC 1191 sold by Elf Atochem, and LODYNE S-107B, LODYNE S-220N, and LODYNE S-222N sold by Ciba-Geigy Corp. A general description of some of these examples include the following:

$$R_fCHCH_2O(CH_2CH_2O)_xH$$

where $R_f$ is $F(CF_2CF_2)_{3-8}$ and

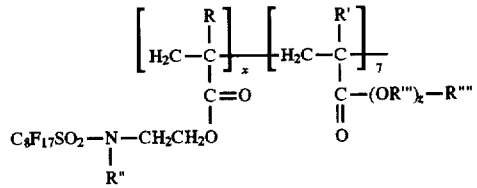

where R, R' can be H or methyl and R and R' can be the same or different, R" is $C_1$ to $C_6$ alkyl and preferably $C_1$ to $C_4$ alkyl, (OR"')z is a poly(oxyalkylene) group, preferably including groups having 2 to 4 carbon atoms such as —$CH_2CH_2$—, —$CH_2CH_2CH_2$—, —$CH(CH_3)CH_2$—, or —$CH(CH_3)CH(CH_3)$—, and R"" is a termial group of H or $C_1$ to $C_4$ alkyl, preferably H or methyl. The ratio of x to y is in the range of 1:1 to 3:1, more preferably in the range of 1:1 to 2:1. Oxyalkylene groups in the poly(oxyalkylene) group may be the same, as in poly(oxyethylene), or two or more of different oxyalkylene units may be irregularly distributed in the poly(oxalkylene) group. More specifically, the poly(oxyalkylene) group may be made up of straight or branched chain oxypropylene units alone or oxyethylene units alone, or straight or branched oxypropylene units and oxyethylene units may be present in alternate blocks. In the case of alternate blocks of oxyethylene and oxypropylene, the ratio of oxyethylene to oxypropylene is in the range of 1.5–1.0 to 1. Also, unattached blocks of poly(oxyalkylene) may be present in the polymer matrix. Chain transfer agents such as octyl mercaptan may also be present.

The formulated amount of nonionic fluorinated surfactant used in the preparation of the protective layer is in the range of 0.005 to 0.02 percent, by weight, of the coating solution, however, when a nonionic fluorinated surfactant is used in the preparation of the backing layer in accordance with this invention, no fluorinated surfactant need be formulated into the protective layer coating solution. When more than one surfactant is present, it is necessary that neither surfactant be present above its individual compatibility limit in the wax.

By "compatibility limit" is meant the weight percentage of surfactant present in the molten wax at the point of incipient turbidity. By "point of incipient turbidity" is meant the point at which an incremental addition of the surfactant to the molten wax causes a level of turbidity visible to the naked eye.

In order to obtain the compatibility limit for a given surfactant in the wax, the following test is performed. 100 grams of wax are heated until the wax is just uniformly molten. The fluorosurfactant is added in 0.5 gram increments and mixed by shaking for 1 minute. The sample is observed for clarity after each addition. The percent by weight of the surfactant present in the wax when the initial sign of turbidity is observed is the "compatibility limit".

Should two or more fluorosurfactants be present in the wax, the "compatibility limit" of each surfactant is an amount of each surfactant in the wax such that the point of incipient turbidity is reached when the next increment of any of the surfactants causes turbidity visible to the naked eye. Thus, for example, when 100 grams of wax are heated until the wax is just molten, 0.5 grams of the first fluorosurfactant are added and mixed by shaking for 1 minute. The clarity is observed for turbidity. 0.5 grams of the second fluorosurfactant are added and shaken for 1 minute and observed. If a third surfactant is to be used, 0.5 grams of it are added and the procedure followed. This cycle is repeated until the initial sign of turbidity is observed. This is the "compatibility limit" for the combination where equal amounts of the surfactants are employed. Of course, other ratios of surfactants can be employed so long as the compatibility limit is not exceeded.

The lubricant layer is coated from a combination of an aromatic solvent and a lower alkyl alcohol having an evaporation rate viable for high speed coating. Preferably, the alkyl group has from 1 to 6 carbon atoms such as, methyl, ethyl, n-propyl, i-propyl, n-butyl, sec-butyl, t-butyl, any of the pentyl isomers, any of the hexyl isomers, and mixtures thereof. The use of a combination of toluene and one or two of the lower alkyl alcohols is preferred. In the solvent mixture, aromatic solvent is used in an amount of from 70 to 95% by weight and preferably 75 to 90% by weight.

In accordance with invention, the protective lubricant layer is prepared by adding the fluorinated surfactant, if used, to the combined aromatic/alcohol solvent system. The solid wax is then dissolved in this solution, with heating and stirring if necessary.

In the preparation of a photographic element having a transparent magnetic recording layer, the magnetic particles have a surface area greater than 30 $m^2$/gm and preferably greater than 40 $m^2$/gm. The coverage of the magnetic particles in the magnetic recording layer varies within the ranges given above depending upon the thickness of the magnetic recording layer. For optimum performance, the magnetic recording layer should be such that normal wear will not result in signal loss after multiple reading and writing operations. However, the layer must not interfere with the photographic properties of the film.

In accordance with this invention, the transparent magnetic layer is prepared by initially forming a high solids content magnetic concentrate by mixing the magnetic particles in a suitable grind solvent together with suitable surfactants and milling in a device such as, for example, a ball mill, a roll mill, a high speed impeller mill, media mill, an attritor or a sand mill. Milling proceeds for a sufficient time to ensure that substantially no agglomerates of the magnetic particles remain. The high solids magnetic concentrate is next diluted with suitable solvents and polymeric stabilizers to maintain the particles in an unagglomerated state (subsequently referred to as the intermediate letdown). Mixing for an additional period of time is continued in order to polish the ingredients.

In a separate container, the binder polymer is dissolved in a suitable solvent. To this solution is added the intermediate letdown in accordance with the procedure set forth above and stirring is continued. A dispersion of the abrasive particles is prepared by milling to break up agglomerates of the abrasive particles and this is added to the mixer containing the binder solution and intermediate letdown. This dispersion may be coated onto a suitable support in its present form or additional and optional ingredients such as crosslinking agents, catalysts, coating aids, filler particles, lubricants and the like, may be added before the coating operation.

The coating composition is applied to a suitable support which may contain additional layers for promoting adhesion, by any suitable coating device including slot die hoppers, slide hoppers, gravure coaters, reverse roll coaters and the like.

Any suitable support may be employed in the practice of this invention, such as, cellulose derivatives including cellulose diacetate, cellulose triacetate, cellulose propionate, cellulose butyrate, cellulose acetatepropionate and the like; polyamides; polycarbonates; polyesters, particularly polyethylene terephthalate, poly-1, 4-cyclohexanedimethylene terephthalate, polyethylene 1, 2-diphenoxyethane-4, 4'-dicarboxylate, polybutylene terephthalate and polyethylene naphthalate; polystyrene, polypropylene, polyethylene, polymethyl-pentene, polysulfone, polyethersulfone, polyarylates, polyether imides and the like. Particularly preferred supports are polyethylene terephthalate, polyethylene naphthalate and the cellulose esters particularly cellulose triacetate.

Thickness of those supports used in the present invention is from 50 μm to 180 μm, preferably, 80 to 125 μm. In addition, various dyes may be formulated into the support or the magnetic layer to give neutral density.

Depending upon the nature of the support, suitable transparent tie or undercoat layers may be desired. Particularly with regard to polyester supports, primers are used in order to promote adhesion. Any suitable primers in accordance with those described in the following U.S. Pat. Nos. may be employed: 2,627,088; 3,501,301; 4,689,359; 4,363,872; and 4,098,952. Each of these are incorporated herein by reference in their entirety.

The ferromagnetic pigments comprise ferromagnetic iron oxides, such as $\gamma$-$Fe_2O_3$, $Fe_3O_4$ or $\gamma$-$Fe_2O_3$ or $Fe_3O_4$ with Co, Zn or other metals in solid solution or surface treated, or ferromagnetic chromium dioxides, such as $CrO_2$ or $CrO_2$ with metallic elements, for example Li, Na, Sn, Pb, Fe, Co, Ni and Zn, or halogen atoms in solid solution. Ferromagnetic metal pigments with an oxide coating on their surface to improve their chemical stability or to improve dispersibility, as is commonly used in conventional magnetic recording, may also be used in accordance with the invention. In addition, magnetic oxides with a thicker layer of lower refractive index oxide or other material having a lower optical scattering cross-section as taught in U.S. Pat. Nos. 5,217,804 and 5,252,444 and U.S. application Ser. No. 08/402,265 filed Mar. 10, 1995, may also be used. These magnetic oxides comprise those listed above that are surface treated wtih silicon oxide, aluminum oxide, alumino-silicate, tin oxide, antimony or indium doped tin oxide, or metal antimonates such as zinc antimonate or indium antimate. Cobalt surface treated iron oxide is the preferred ferromagnetic material for use in accordance with this invention.

Abrasive particles may be used in accordance with this invention as described in U.S. Pat. No. 5,434,037 and U.S. Ser. No. 08/393,523. Examples of the abrasive particles include nonmagnetic inorganic powders with a Mohs scale hardness of not less than 6. Specific examples are metal oxides such as alpha-alumina, chromium oxide ($Cr_2O_3$), alpha-$Fe_2O_3$, silicon dioxide, alumino-silicate and titanium dioxide; carbides such as silicon carbide and titanium carbide; nitrides such as, silicon nitride, titanium nitride and diamond in fine powder. Alpha alumina and silicon dioxide are the preferred abrasives in accordance with this invention.

Reinforcing filler particles may be used in accordance with this invention as described in U.S. Pat. Nos. 5,432,050 and 5,436,120, both of which are incorporated herein by reference. In addition, conductive filler/abrasive particles may be used as described in U.S. Pat. No. 5,427,900 which is incorporated herein by reference.

The binders used in the magnetic layer include, for example, vinyl chloride-vinyl acetate copolymers, vinyl chloride-vinyl acetate-vinyl alcohol copolymers, vinyl chloride-vinyl acetate-maleic acid polymers, vinyl chloride-vinylidene chloride copolymers, vinyl chloride-acrylonitrile copolymers, acrylic ester-acrylonitrile copolymers, acrylic ester-vinylidene chloride copolymers, methacrylic ester-vinylidene chloride copolymers, methacrylic ester-styrene copolymers, thermoplastic polyurethane resins, phenoxy resins, polyvinyl fluoride, vinylidene, chloride-acrylonitrile copolymers, butadiene-acrylonitrile copolymers, acrylonitrile-butadiene-acrylic acid copolymers, acrylonitrile-butadiene-methacrylic acid copolymers, polyvinyl butyral, polyvinyl acetal, cellulose derivatives, styrene-butadiene copolymers, polyester resins, phenolic resins, epoxy resins, thermosetting polyurethane resins, urea resins, melamine resins, alkyl resins, urea-formaldehyde resins and the like. Of the above, the cellulose derivatives are the preferred binders for use in accordance with this invention. Cellulose derivatives include cellulose esters such as, for example, cellulose acetate, cellulose diacetate, cellulose triacetate, cellulose acetate butyrate, cellulose acetate propionate, and the like. The most preferred binder is cellulose diacetate. For crosslinking of the binder with isocyanates, the binder should contain active hydrogen atoms as determined by the Zerewitinoff test, such active hydrogen atoms including —OH, —$NH_2$ —NHR, where R is an organic radical, and the like, as described in U.S. Pat. No. 3,479,310.

A dispersing agent, sometimes referred to as a wetting agent or a surface active agent, can be present in the dispersion to facilitate dispersion of the magnetic and/or reinforcing filler and/or abrasive particles and/or wetting of the particles with the dispersing medium. This helps to further minimize agglomeration of the magnetic particles. The dispersing agent can be present in the dispersion in an amount up to about 0.02%, preferably 0.001 to 0.01%, by weight. Useful dispersing agents include fatty acid amines, and commercially available wetting agents such as Witco Emcol CC59 which is a quaternary amine available from Witco Chemical Corp. Rhodafac PE 510, Rhodafac RE 610, Rhodafac RE 960, and Rhodafac LO 529 which are phosphoric acid esters available from Rhone-Poulenc. Other constituents of the coating composition including grind solvents, coating aids, and solvents for the binder are included. Suitable grind solvents include, for example, an ester of an acid such as phthalic acid. Preferred esters are dialkylesters of phthalic acid, the alkyl portion of which can contain from 1 to about 12, preferably 4 to 8, carbon atoms. Exemplary useful esters include dimethyl phthalate, diethyl phthalate, dioctyl phthalate, dipropyl phthalate, and dibutyl phthalate as disclosed in U.S. Pat. No. 4,990,276 issued to Bishop et al. and assigned to the same assignee as this application.

Suitable coating aids for the backing layer include those mentioned above for the preparation of the protective layer, and in addition, polysiloxanes such as Dow Corning DC 1248, DC 200, DC 510, DC 190 and BYK 310, BYK 320, and BYK 322 sold by BYK Chemie and SF 1079, SF 1023, SF 1054 and SF 1080 sold by General Electric. The amount of coating aid used is typically in the range of 0.0015 to 0.025 percent, by weight, of the dispersion.

Organic solvents are normally used for the preparation of the dispersion. Examples of suitable solvents are ketones, such as acetone, methyl ethyl ketone and cyclohexanone, alcohols, esters, such as ethyl acetate and butyl acetate, cellosolves, ethers, such as tetrahydrofuran aromatic solvents, such as toluene, and chlorinated hydrocarbons as solvents, such as carbon tetrachloride, chloroform, dichloromethane; tetrahydrofuran and the ketoesters of U.S. Pat. No. 5,397,826, issued Mar. 14, 1995, entitled Coating Compositions For A Transparent Magnetic Recording Layer, by R. M. Wexler, assigned to the same assignee as the immediate application, which are preferred.

Optionally, the binder in the magnetic layer may be crosslinked employing any suitable crosslinking agent such as, for example, organic isocyanates; aziridines, as taught in U.S. Pat. No. 4,225,665; and melamines such as methoxymethylmelamine, and the like as set forth in U.S. Pat. No. 5,198,499 to Anderson et al. issued Mar. 30, 1993, and assigned to the same assignee as this application.

Any suitable organic polyisocyanate can be used as the crosslinking agent such as, tetramethylene diisocyanate, hexamethylene diisocyanate, diisocyanato dimethylcyclohexane, dicyclohexylmethane diisocyanate, isophorone diisocyanate, dimethylbenzene diisocyanate, methylcyclohexylene diisocyanate, lysine diisocyanate, tolylene diisocyanate, diphenylmethane diisocyanate, polymers of the foregoing, polyisocyanates prepared by reacting an excess of an organic diisocyanate with an active hydrogen containing compounds such as polyols, polyethers and polyesters and the like including ethylene glycol, propylene glycol, dipropylene glycol, butylene glycol, trimethylol propane, hexanetriol, glycerine, sorbitol, pentaerythritol, caster oil, ethylenediamine, hexamethylenediamine, ethanolamine, diethanolamine, triethanolamine, water, ammonia, urea and the like, including biuret compounds, allophanate compounds and the like. The preferred polyisocyanates employed as a crosslinking agent is the reaction product of trimethylol propane and 2,4-tolylene diisocyanate sold by Bayer Co. under the trade designation Mondur CB 75.

As noted, photographic elements in accordance with this invention comprise at least one photosensitive layer. Such photosensitive layers can be image-forming layers containing photographic silver halides such as silver chloride, silver bromide, silver bromoiodide, silver chlorobromide and the like. Both negative and reversal silver halide elements are contemplated. For reversal films, the emulsion layers as taught in U.S. Pat. No. 5,236,817, especially Examples 16 and 21, are particularly suitable. Any of the known silver halide emulsion layers, such as those described in Research Disclosure, Vol. 176, December 1978, Item 17643 and Research Disclosure Vol. 225, January 1983, Item 22534, the disclosures of which are incorporated by reference in their entirety, are useful in preparing photographic elements in accordance with this invention. Generally, the photographic element is prepared by coating the support film on the side opposite the magnetic recording layer with one or more layers comprising a dispersion of silver halide crystals in an aqueous solution of gelatin and optionally one or more subbing layers such as, for example, gelatin, etc. The coating process can be carried out on a continuously operating machine wherein a single layer or a plurality of layers are applied to the support. For multicolor elements, layers can be coated simultaneously on the composite support film as described in U.S. Pat. No. 2,761,791 and U.S. Pat. No. 3,508,947. Additional useful coating and drying procedures are described in Research Disclosure, Vol. 176, December 1978, Item 17643. Suitable photosensitive image forming layers are those which provide color or black and white images.

As is taught in U.S. Pat. No. 3,782,947 noted above, whether an element is useful for both photographic and magnetic recording depends on both the size distribution and concentration of the magnetic particles and on the relationship between the granularities of the magnetic and photographic coatings. Generally, of course, the coarser the grain of the emulsion in the photographic element that contains the magnetic recording layer, the larger the mean size of the magnetic particles which can be tolerated. A magnetic particle concentration between about 10 and 1000 mg/m$^2$ when uniformly distributed across the desired area of the photographic element will be sufficiently photographically transparent provided that the maximum particle size is less than about 1 μm. Particle concentrations less than about 10 mg/m$^2$ tend to be insufficient for magnetic recording purposes and particle concentrations greater than about 1000 mg/m$^2$ tend to be too dense for photographic purposes. Particularly useful particle concentrations are in the range of 20–70 mg/m$^2$. Concentrations of about 20 mg/m$^2$ have been found to be particularly useful in reversal films and concentrations of about 40 mg/m$^2$ are particularly useful in negative films.

The photographic elements according to this invention can contain one or more conducting layers such as antistatic layers and/or anti-halation layers such as described in Research Disclosure, Vol. 176, December 1978, Item 17643, to prevent undesirable static discharges during manufacture, exposure and processing of the photographic element. Antistatic layers conventionally used in color films have been found to be satisfactory for use herewith. Any of the antistatic agents set forth in U.S. Pat. No. 5,147,768, which is incorporated herein by reference may be employed. Preferred antistats include metal oxides, for example, tin oxide, antimony doped tin oxide, zinc antimonate, indium antimonate and vanadium pentoxide.

The invention will be further illustrated by the following examples in which parts and percentages are given by weight unless otherwise specified.

EXAMPLE 1

A cellulose diacetate/cellulose triacetate binder with magnetic particles is cast to a dry thickness of about 1.2 micrometers onto subbed polyethylene naphthalate from dispersion compositions as shown in Table 1. The dispersions are prepared by adding the respective particle dispersions with respective stabilizing agents and solvents to a cellulose diacetate solution in methylene chloride/acetone/methyl acetoacetate using a high shear mixer. A coating aid is then added with low shear. Subsequently, the cast layers are overcoated with 2 micrograms/sq. cm. of carnauba wax from the formulation shown in Table 1.

TABLE 1

| Dispersion Ingredient | Function | Percent |
|---|---|---|
| Backing Layer | | |
| Cellulose Diacetate | Binder | 2.815 |
| Cellulose Triacetate | Binder/Dispersion Stabilizer | 0.125 |
| CSF-4085V2 (Toda Kogyo) | Magnetic Particle | 0.125 |
| Rhodafac PE510 | Surfactant | 0.006 |
| Dibutyl Phthalate | Grind Solvent | 0.25 |
| E-600 (Norton Chemical) | Abrasive Particle | 0.08 |
| Solsperse 24000 (Zeneca Inc.) | Dispersant | 0.004 |
| FC-431 (3M) | Coating Aid | 0.015 |
| Methylene chloride | Solvent | 67.606 |
| Acetone | Solvent | 24.145 |
| Methyl acetoacetate | Solvent | 4.829 |
| Protective Lubricating Layer | | |
| Carnauba Wax | Lubricant | 0.219 |
| FC-430 (3M) | Coating Aid | 0.015 |
| Toluene | Solvent | 79.813 |
| Methanol | Solvent | 19.953 |

EXAMPLE 2

A structure is coated as described in Example 1 except that no coating aid is added to the lubricant layer formulation.

EXAMPLE 3

A structure is coated as described in Example 2 except that less coating aid is added to the backing layer formulation, as shown in Table 2.

TABLE 2

| Dispersion Ingredient | Function | Percent |
|---|---|---|
| Backing Layer | | |
| Cellulose Diacetate | Binder | 2.815 |
| Cellulose Triacetate | Binder/Dispersion Stabilizer | 0.125 |
| CSF-4085V2 (Toda Kogyo) | Magnetic Particle | 0.125 |
| Rhodafac PE510 | Surfactant | 0.006 |
| Dibutyl Phthalate | Grind Solvent | 0.25 |
| E-600 (Norton Chemical) | Abrasive Particle | 0.08 |
| Solsperse 24000 (Zeneca Inc.) | Dispersant | 0.004 |
| FC-431 (3M) | Coating Aid | 0.002 |
| Methylene chloride | Solvent | 67.615 |
| Acetone | Solvent | 24.148 |
| Methyl acetoacetate | Solvent | 4.830 |
| Protective Lubricating Layer | | |
| Carnauba Wax | Lubricant | 0.219 |
| Toluene | Solvent | 79.825 |
| Methanol | Solvent | 19.956 |

EXAMPLE 4

A structure is coated as described in Example 1 except that the coating aid in the backing layer formulation is different and an additional solvent is used to coat the lubricant layer, as shown in Table 3.

TABLE 3

| Dispersion Ingredient | Function | Percent |
|---|---|---|
| Backing Layer | | |
| Cellulose Diacetate | Binder | 2.815 |
| Cellulose Triacetate | Binder/Dispersion Stabilizer | 0.125 |
| CSF-4085V2 (Toda Kogyo) | Magnetic Particle | 0.125 |
| Rhodafac PE510 | Surfactant | 0.006 |
| Dibutyl Phthalate | Grind Solvent | 0.25 |
| E-600 (Norton Chemical) | Abrasive Particle | 0.08 |
| Solsperse 24000 (Zeneca Inc.) | Dispersant | 0.004 |
| FC430 (3M) | Coating Aid | 0.015 |
| Methylene chloride | Solvent | 67.606 |
| Acetone | Solvent | 24.145 |
| Methyl acetoacetate | Solvent | 4.829 |
| Protective Lubricating Layer | | |
| Carnauba Wax | Lubricant | 0.219 |
| FC-430 (3M) | Coating Aid | 0.015 |
| Toluene | Solvent | 74.825 |
| Isopropanol | Solvent | 19.953 |
| 1-Butanol | Solvent | 4.988 |

COMPARATIVE EXAMPLE C-5

A structure is coated as in Example 1 except that the same coating aid is used in both the backing layer and the lubricant layer, as shown in Table 4.

TABLE 4

| Dispersion Ingredient | Function | Percent |
|---|---|---|
| Backing Layer | | |
| Cellulose Diacetate | Binder | 2.815 |
| Cellulose Triacetate | Binder/Dispersion Stabilizer | 0.125 |
| CSF-4085V2 (Toda Kogyo) | Magnetic Particle | 0.125 |
| Rhodafac PE510 | Surfactant | 0.006 |
| Dibutyl Phthalate | Grind Solvent | 0.25 |
| E-600 (Norton Chemical) | Abrasive Particle | 0.08 |
| Solsperse 24000 (Zeneca Inc.) | Dispersant | 0.004 |
| FC-431 (3M) | Coating Aid | 0.015 |
| Methylene chloride | Solvent | 67.606 |
| Acetone | Solvent | 24.145 |
| Methyl acetoacetate | Solvent | 4.829 |
| Protective Lubricating Layer | | |
| Carnauba Wax | Lubricant | 0.219 |
| FC-431* (3M) | Coating Aid | 0.015 |
| Toluene | Solvent | 99.766 |

*The combination of the fluorinated surfactant in the protective lubricating layer and in the backing layer results in an amount of fluorinated surfactant in the protective lubricating layer that exceeds the compatibility limit of its fluorinated surfactant in the carnauba wax.

COMPARATIVE EXAMPLE C-6

A structure is coated as described in Example 3 except that less coating aid is added to the backing layer formulation, as shown in Table 5.

TABLE 5

| Dispersion Ingredient | Function | Percent |
|---|---|---|
| Backing Layer | | |
| Cellulose Diacetate | Binder | 2.80 |
| Cellulose Triacetate | Binder/Dispersion Stabilizer | 0.125 |
| CSF-4085V2 (Toda Kogyo) | Magnetic Particle | 0.125 |
| Rhodafac PE510 | Surfactant | 0.006 |
| Dibutyl Phthalate | Grind Solvent | 0.25 |
| Sumitomo AKP-50 | Abrasive Particle | 0.125 |
| Solsperse 24000 (Zeneca Inc.) | Dispersant | 0.006 |
| FC-431 (3M) | Coating Aid | 0.001 |
| Methylene chloride | Solvent | 67.593 |
| Acetone | Solvent | 24.141 |
| Methyl acetoacetate | Solvent | 4.828 |
| Protective Lubricating Layer | | |
| Carnauba Wax | Lubricant | 0.219 |
| Toluene | Solvent | 79.825 |
| Methanol | Solvent | 19.956 |

COMPARATIVE EXAMPLE C-7

A structure is coated as in Example C-5 except that no coating aid is used in the lubricant layer coating solution, as shown in Table 6.

TABLE 6

| Dispersion Ingredient | Function | Percent |
|---|---|---|
| Backing Layer | | |
| Cellulose Diacetate | Binder | 2.815 |
| Cellulose Triacetate | Binder/Dispersion Stabilizer | 0.125 |
| CSF-4085V2 (Toda Kogyo) | Magnetic Particle | 0.125 |
| Rhodafac PE510 | Surfactant | 0.006 |

TABLE 6-continued

| Dispersion Ingredient | Function | Percent |
|---|---|---|
| Dibutyl Phthalate | Grind Solvent | 0.25 |
| E-600 (Norton Chemical) | Abrasive Particle | 0.08 |
| Solsperse 24000 (Zeneca Inc.) | Dispersant | 0.004 |
| FC-431 (3M) | Coating Aid | 0.015 |
| Methylene chloride | Solvent | 67.606 |
| Acetone | Solvent | 24.145 |
| Methyl acetoacetate | Solvent | 4.829 |
| Protective Lubricating Layer | | |
| Carnauba Wax | Lubricant | 0.219 |
| Toluene | Solvent | 99.781 |

EXAMPLES 8–11 and COMPARATIVE EXAMPLES C-12 thru C-14

A color photographic recording material for color negative development is prepared by applying the following layers in the given sequence to the opposite side of each of the supports of Examples 1–3 and Comparative Examples C-4 and C-5, respectively. The quantities of silver halide are given in grams (g) of silver per $m^2$. The quantities of other materials are given in g per $m^2$.

Layer 1 {Antihalation Layer} black colloidal silver sol containing 0.236 g of silver, with 2.44 g gelatin.

Layer 2 {First (least) Red-Sensitive Layer} Red sensitized silver iodobromide emulsion [1.3 mol % iodide, average grain diameter 0.55 μm, average thickness 0.08 μm] at 0.49 g, red sensitized silver iodobromide emulsion [4 mol % iodide, average grain diameter 1.0 μm, average thickness 0.09 μm] at 0.48 g, cyan dye-forming image coupler C-1 at 0.56 g, cyan dye-forming masking coupler CM-1 at 0.033 g, BAR compound B-1 at 0.039 g, with gelatin at 1.83 g.

Layer 3 {Second (more) Red-Sensitive Layer} Red sensitive silver iodobromide emulsion [4 mol % iodide, average grain diameter 1.3 μm, average grain thickness 0.12 ] at 0.72 g, cyan dye-forming image coupler C-1 at 0.23 g, cyan dye-forming masking coupler CM-1 at 0.022 g, DIR compound D-1 at 0.011 g, with gelatin at 1.66 g.

Layer 4 {Third (most) Red-Sensitive Layer} Red sensitized silver iodobromide emulsion [4 mol % iodide, average grain diameter 2.6 μm, average grain thickness 0.13 μm] at 1.11 g, cyan dye-forming image coupler C-1 at 0.13 g, cyan dye-forming masking coupler CM-1 at 0.033 g, DIR compound D-1 at 0.024 g, DIR compound D-2 at 0.050 g, with gelatin at 1.36 g.

Layer 5 {Interlayer} Yellow dye material YD-1 at 0.11 g and 1.33 g of gelatin.

Layer 6 {First (least) Green-Sensitive Layer} Green sensitized silver iodobromide emulsion [1.3 mol % iodide, average grain diameter 0.55 μm, average grain thickness 0.08 μm] at 0.62 g, green sensitized silver iodobromide emulsion [4 mol % iodide, average grain diameter 1.0 μm, average grain thickness 0.09 μm] at 0.32 g, magenta dye-forming image coupler M-1 at 0.24 g, magenta dye-forming masking coupler MM-1 at 0.067 g with gelatin at 1.78 g.

Layer 7 {Second (more) Green-Sensitive Layer} Green sensitized silver iodobromide emulsion [4 mol % iodide, average grain diameter 1.25 μm, average grain thickness 0.12 μm] at 1.00 g, magenta dye-forming image coupler M-1 at 0.091 g, magenta dye-forming masking coupler MM-1 at 0.067 g, DIR compound D-1 at 0.024 g with gelatin at 1.48 g.

Layer 8 {Third (most) Green-Sensitive Layer} Green sensitized silver iodobromide emulsion [4 mol % iodide, average grain diameter 2.16 μm, average grain thickness 0.12 μm] at 1.00 g, magenta dye-forming image coupler M-1 at 0.0.72 g, magenta dye-forming masking coupler MM-1 at 0.056 g, DIR compound D-3 at 0.01 g, DIR compound D-4 at 0.011 g, with gelatin at 1.33 g.

Layer 9 {Interlayer} Yellow dye material YD-2 at 0.11 g with 1.33 g gelatin.

Layer 10 {First (less) Blue-Sensitive Layer} Blue sensitized silver iodobromide emulsion [1.3 mol % iodide, average grain diameter 0.55, average grain thickness 0.08 μm] at 0.24 g, blue sensitized silver iodobromide emulsion [6 mol % iodide, average grain μm diameter 1.0, average grain thickness 0.26 μm] at 0.61 g, yellow dye-forming image coupler Y-1 at 0.29 g, yellow dye forming image coupler Y-2 at 0.72 g, cyan dye-forming image coupler C-1 at 0.017 g, DIR compound D-5 at 0.067 g, BAR compound B-1 at 0.003 g with gelatin at 2.6 g.

Layer 11 {Second (more) Blue-Sensitive Layer} Blue sensitized silver iodobromide emulsion [4 mol % iodide, average grain diameter 3.0 μm, average grain thickness 0.14 μm] at 0.23 g, blue sensitized silver iodobromide emulsion [9 mol % iodide, average grain diameter 1.0 μm] at 0.59 g, yellow dye-forming image coupler Y-1 at 0.090 g, yellow dye-forming image coupler Y-2 at 0.23 g, cyan dye-forming image coupler C-1 0.022 g, DIR compound D-5 at 0.05 g, BAR compound B-1 at 0.006 g with gelatin at 1.97 g.

Layer 12 {Protective Layer} 0.111 g of dye UV-1, 0.111 g of dye UV-2, unsensitized silver bromide Lippman emulsion at 0.222 g, 2.03 g.

This film is hardened at coating with 2% by weight to total gelatin of hardener H-1. Surfactants, coating aids, scavengers, soluble absorber dyes and stabilizers are added to the various layers of this sample as is commonly practiced in the art.

The formulae for the component materials are as follows:

C-1:

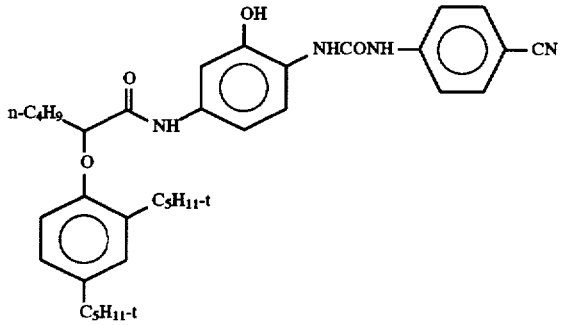

CM-1:

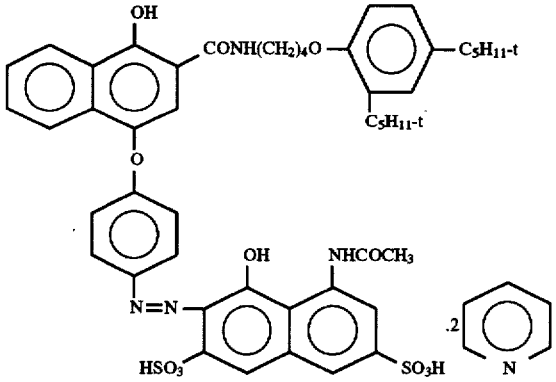

B-1:

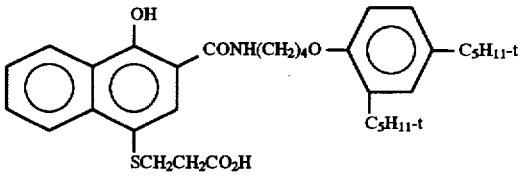

-continued
D-1:
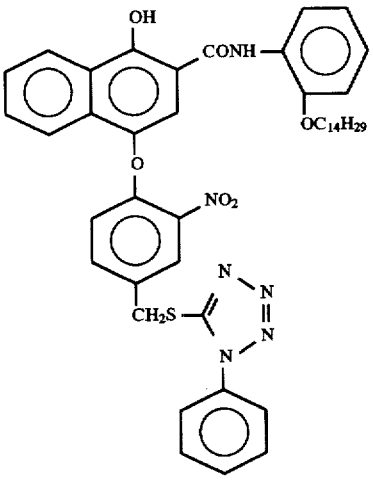
D-2:
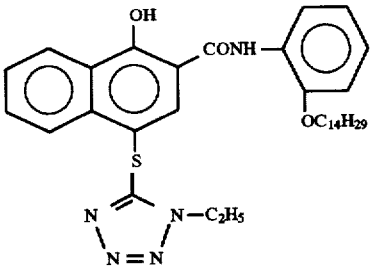
D-3
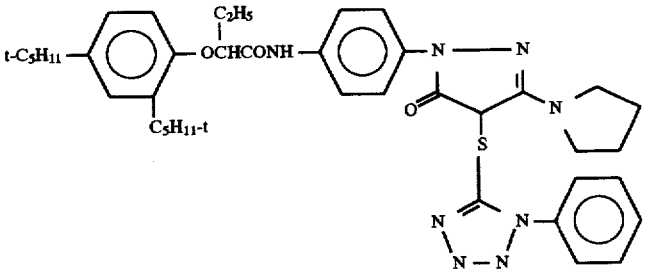
D-4:
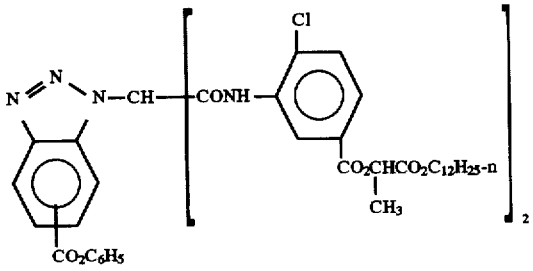

-continued
D-5:
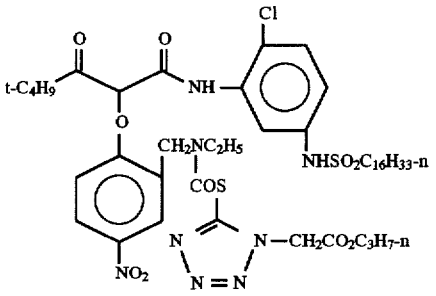
MM-1:
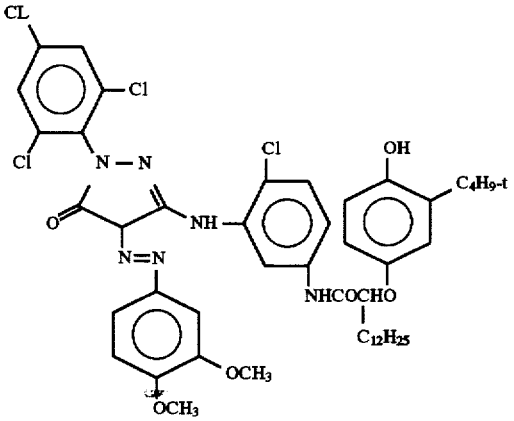
Y-1:
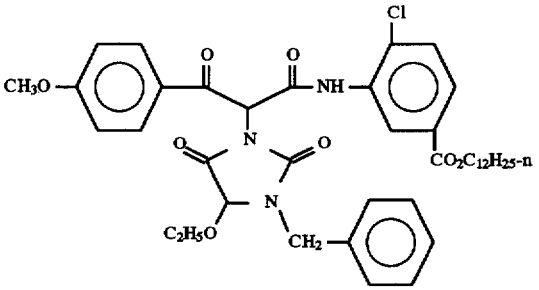
Y-2:
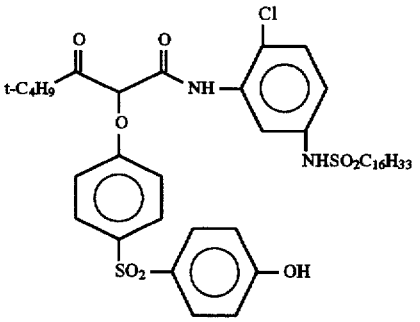

-continued
M-1:
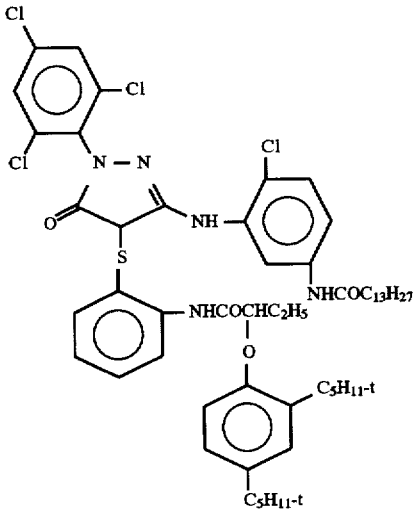
YD-1:
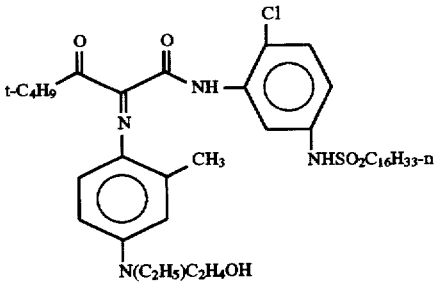
YD-2:
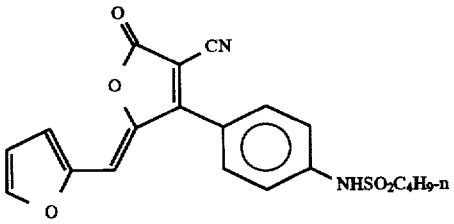
UV-1:
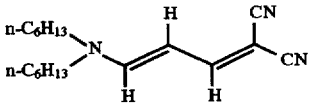
UV-2:
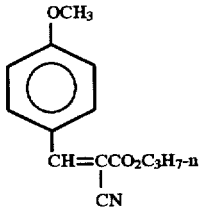
H-1:
CH2(SO2CH=CH2)2

EVALUATION METHODS

Backing Layer Appearance

The backing layer is subjectively judged for coating quality by its transparency or haziness under room fluorescent lighting.

Post Processing Appearance

The emulsion coated examples are developed in a process C-41 Cine processor. The backing is subjectively evaluated for streaking defects under room fluorescent lighting in reflection.

Critical Surface Tension

Contact angles of various liquids are measured on the lubricated backing using a Rame'-Hart goniometer in an ambient environment. Advancing angles are determined by successively increasing the drop size and recording the equilibrium advancing contact angle. The angle on both sides of the drop is observed and the average taken. A freshly flamed platinum wire is used to apply drops of the test liquids to the surface.

Contact angle data are presented according to the technique of Zisman (Advances Chem. 43 1 (1964)). The critical surface tension (CST) is determined from a linear regression analysis of the data at the point where cos $\theta$=1. The CST yields the surface energy of the lubricated backing surface. Values below about 20 dynes/cm indicate that the surface contains fluorinated molecules.

Protective Lubricating Layer Coating Solution Resistivity

The lubricating layer coating solution conductivity is measured using an Emcee Model No. 1154 KSLA Cell and Precision Conductivity meter System which is modified to measure conductivity in the 1 to 2,500,000 pS/m range. The measurement is carried out in accordance with ASTM Test Method D 4308. In order to avoid static discharge ignition of the coating solution during high speed coating operations, it is necessary to have solution resistivity below $1\times10^9$ ohms/cm.

TABLE 7

| Example | Backing Layer Clarity | Post-Process Streaks on Backing | Critical Surface Tension (dynes/cm) | Protective Lubricating Layer Coating Solution Resistivity (ohms/cm) |
|---|---|---|---|---|
| Examples 1 and 8 | Clear | No | 17.9 | $4\times10^7$ |
| Examples 2 and 9 | Clear | No | 19.2 | $4\times10^7$ |
| Examples 3 and 10 | Clear | No | 19.8 | $4\times10^7$ |
| Examples 4 and 11 | Clear | No | 19.4 | $4\times10^7$ |
| Comparative Examples C-5 and C-12 | Clear | Yes | 18.5 | $8\times10^9$ |
| Comparative Examples C-6 and C-13 | Hazy | No | 22.3 | $4\times10^7$ |
| Comparative Examples C-7 and C-14 | Clear | No | 19.8 | $8\times10^9$ |

The invention has been described in detail with particular reference to preferred embodiments thereof, but it will be understood that variations and modifications can be effected within the spirit and scope of the invention.

What is claimed is:

1. A photographic element comprising a support, a light-sensitive layer on one side of the support, and on the other side of the support, at least one backing layer and a protective outermost lubricating layer, the protective layer comprising a solid wax and a non-ionic fluorinated surfactant in an amount less than the compatibility limit of the surfactant in the wax, said protective layer being coated from a mixture of an aromatic solvent and at least one lower alkyl alcohol.

2. The photographic element of claim 1 wherein the solid wax has a melting point greater than 55° C.

3. The photographic element of claim 1 wherein the solid wax comprises carnauba wax.

4. The photographic element of claim 1 wherein the aromatic solvent comprises benzene, toluene, ortho-xylene, meta-xylene, para-xylene or mixtures thereof.

5. The photographic element of claim 1 wherein the aromatic solvent is present in an amount of from 70 to 95 percent by weight of said mixture.

6. The photographic element of claim 1 wherein the aromatic solvent is present in an amount of from 75 to 90 percent by weight of said mixture.

7. The photographic element of claim 1 wherein the aromatic solvent comprises toluene.

8. The photographic element of claim 1 wherein the lower alkyl alcohol contains from 1 to 6 carbon atoms.

9. The photographic element of claim 3 wherein the carnauba wax is present in an amount of 0.5 to 3 micrograms/cm$^2$.

10. The photographic element of claim 3 wherein the carnauba wax is present in an amount of 1 to 2.5 micrograms/cm$^2$.

11. The photographic element of claim 3 wherein the carnauba wax is present in an amount of 1.5 to 2 micrograms/cm$^2$.

12. The photographic element of claim 9 wherein the aromatic solvent is toluene and the lower alkyl alcohol has from 1 to 4 carbon atoms.

13. The photographic element of claim 1 wherein the backing layer is a transparent magnetic recording layer.

* * * * *